United States Patent [19]

Akiyama

[11] 4,133,984

[45] Jan. 9, 1979

[54] PLUG-TYPE HEARING DEVICE

[75] Inventor: Taichiro Akiyama, Tokyo, Japan

[73] Assignee: Koken Co., Ltd., Tokyo, Japan

[21] Appl. No.: 821,547

[22] Filed: Aug. 3, 1977

[30] Foreign Application Priority Data

Sep. 1, 1976 [JP] Japan ..... 51-104383

[51] Int. Cl.[2] ..... H04R 1/10; H04R 25/02

[52] U.S. Cl. ..... 179/107 E; 179/182 R; 181/135

[58] Field of Search ..... 179/107 E, 182 R, 182 A; 181/130, 131, 132, 133, 134, 135

[56] References Cited

U.S. PATENT DOCUMENTS

| | | | |
|---|---|---|---|
| 2,803,247 | 8/1957 | Zwislocki | 181/135 |
| 2,824,558 | 2/1958 | Michael et al. | 181/135 |
| 3,080,011 | 3/1963 | Henderson | 179/182 R |
| 3,110,356 | 11/1963 | Mendelson | 179/182 R |
| 3,505,999 | 4/1970 | Harvey et al. | 181/130 |
| 3,602,654 | 8/1971 | Victoreen | 179/182 R |
| 4,006,796 | 2/1977 | Coehorst | 179/182 R |

*Primary Examiner*—George G. Stellar
*Attorney, Agent, or Firm*—McDougall, Hersh & Scott

[57] ABSTRACT

A plug-type hearing device comprising a sound-leading portion being inserted into the auditory miatus, a first envelope attached around the sound-leading portion, a second envelope being positioned at the outside of the auditory miatus and being communicated with the first envelope through a pipe, and a holding means for holding an expanded state of the first envelope when the volume of the latter is increased, wherein the volume of the second envelope is decreased to increase the volume of the first envelope by the pressure of a fluid contained inside, and the expanded first envelope is closely contacted with the wall surface of the auditory miatus.

28 Claims, 17 Drawing Figures

PLUG-TYPE HEARING DEVICE

BACKGROUND OF THE INVENTION

1. Field of the Invention

This invention relates to a plug-type hearing device, particularly to an earphone of a hearing aid.

2. DESCRIPTION OF THE PRIOR ART

In the conventional hearing aid, a connector is connected with an apparatus which serves to convert an outsound into an electric signal and to amplify the electric signal. The end of the connector is connected with an earphone. The earphone serves to convert the electric signal into a sound. The earphone has a pipe-shaped sound-leading portion used for introducing the sound into the external auditory miatus. When the sound-leading portion is inserted into the external auditory miatus to attach the whole of the earphone to the ear, the sound-leading portion does not tightly contact with the external auditory miatus because the size of the latter is different for any person. Accordingly, the earphone is liable to fall off from the ear, and when it is forced to be inserted, the user or patient has a pain in his ear and the external auditory miatus is injured.

SUMMARY OF THE INVENTION

It is an object of this invention to provide a plug-type hearing device which can suitably and closely contact with the auditory miatus having any size.

It is another object of this invention to provide a plug-type hearing device which can be easily and surely attached to the ear.

In accordance with an aspect of this invention, the plug-type hearing device comprising a sound-leading portion being inserted into the auditory miatus and being used for introducing a sound thereinto, an envelope formed around the sound-leading portion, and means for holding the expanded state of the envelope when the volume of the latter is increased by supplying a fluid thereinto, the expanded envelope being closely contacted with a wall surface forming the auditory miatus.

DESCRIPTION OF THE PREFERRED EMBODIMENTS

Embodiments of this invention which will be applied to hearing aid, will be described with reference to the drawings.

Figure 1:
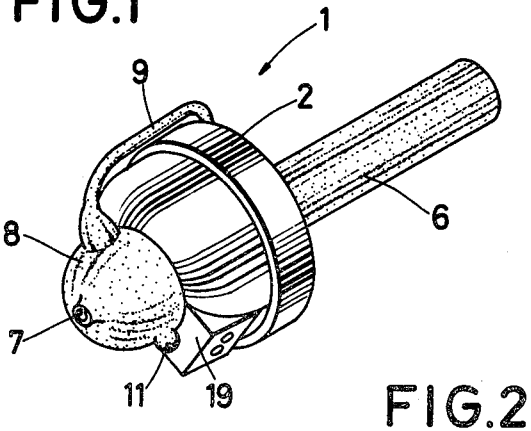
FIG. 1 is a perspective view of an earphone part according to a first embodiment of this invention.
Figure 2:
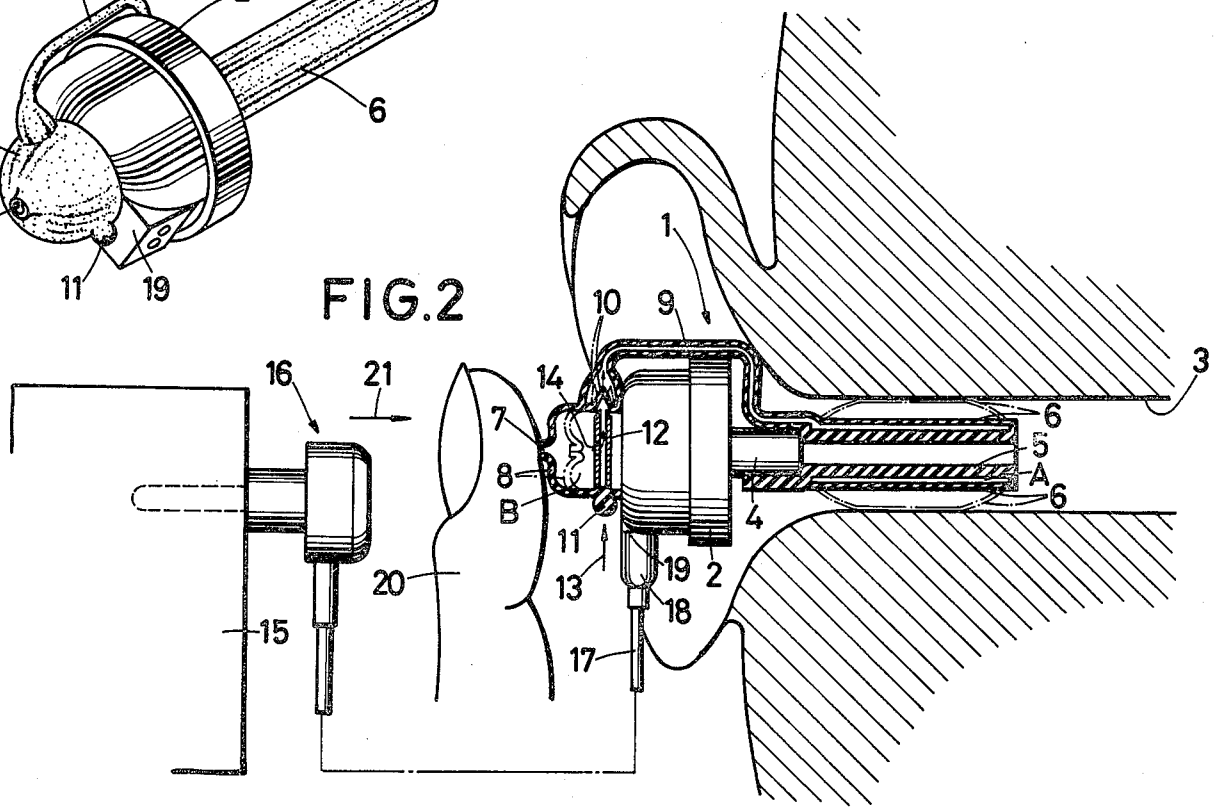
FIG. 2 is a partial cross-sectional view of the earphone part in FIG. 1 which is setted by a connector and is inserted into the external auditory miatus.
Figure 3:
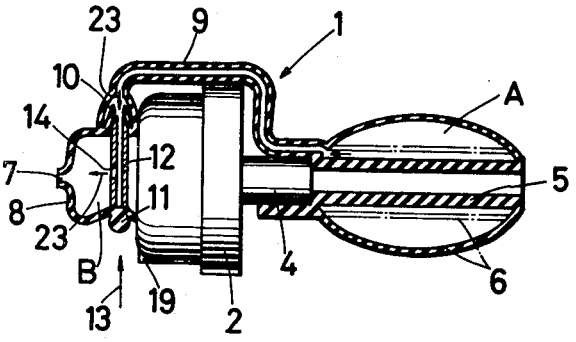
FIG. 3 is a partial cross-sectional view of the earphone part in FIG. 1 when a first envelope is expanded.

FIG. 1 to FIG. 3 show a first embodiment of this invention.

In an earphone part 1 of a hearing aid, a sound-leading pipe 4 is fixed to the center of the bottom of a housing 2. A tubular sound-leading portion 5 made of a relatively hard silicone rubber is fixed closely to the sound-leading pipe 4. Sound is introduced into the external auditory miatus 3 through the sound-leading pipe 4 and the tubular sound-leading portion 5. The tubular sound-leading portion 5 functioning as core material allows the earphone 1 to be easily inserted into the external auditory miatus 3. An envelope 6 made of soft flexible thin material such as a film of silicone rubber is combined with the tubular sound-leading portion 5 so as to envelope the outer surface of the tubular sound-leading portion 5. A first chamber A is formed by the tubular sound-leading portion 5 and the envelope 6. A substantially semi-spherical hollow head 8 made of silicone rubber is fixed to the upper portion of the housing 2. A second chamber B is formed by the hollow head 8 and the upper portion of the housing 2. A small opening 7 is made in the central portion of the hollow head 8. The second chamber B communicates, through a tube 9 made of silicone rubber, with the first chamber A formed by the envelope 6 and the tubular sound-leading portion 5.

A check valve 10 is arranged at the connecting part between hollow head 8 and the tube 9. When air is forced to flow from the second chamber B to the first chamber A, the check valve 10 is opened. However, the air flow from the first chamber A to the second chamber B is intercepted with the check valve 10 closed. A hard pipe 12 is arranged in the second chamber B, and combined with the hollow head 8. A knob 11 is formed on the end of the hard pipe 12, integrally with the hollow head 8. The top end of the hard pipe 12 faces to the check valve 10. When the knob 11 is pushed by finger in the direction shown by an arrow 13 on FIG. 3, the hard pipe 12 is moved to the check valve 10 with the deformation of the hollow head 8 as shown by the solid line on FIG. 3, so as to open the check valve 10. A small opening 14 is made in the pipe 12. As described hereinafter, air from the first chamber A can be led through the small opening 14 of the pipe 12 to the external.

A socket 19 is formed integrally with the housing 2 of the earphone part 1. A plug 18 is fixed to one end of a lead wire 17 is inserted into the socket 19. Another end of the lead wire 17 is fixed to a connector 16 which is connected to a transducer 15 containing an amplifier.

Next, operation of the above-described hearing aid will be described.

First, the plug 18 is inserted into the socket 19. The sound-leading portion 5 of the earphone part 1 is then inserted into the external auditory miatus 3. Since the envelope 6 is still withered, the sound-leading portion 5 enveloped with the envelope 6 is easily inserted to a desirable position of the external auditory miatus 3, as shown in FIG. 2. A finger 20 is applied to the small opening 7 of the hollow head 8. Then, the hollow head 8 is pushed in the direction shown by an arrow 21 on FIG. 2, by the finger 20. The hollow head 8 is resiliently deformed to reduce in volume, as shown by the dot-dash line. The pressure of air increases in the second chamber B. The check valve 10 is forced to open by the pressure of air. Air is forced to flow into the tube 9, corresponding to the volume reduction of the hollow head 8. The envelope 6 is expanded by a certain volume with the air flowing from the pipe 9. Then, the finger 20 is slightly separated from the small opening 7 of the hollow head 8. The hollow head 8 is recovered to its original form with its resilience. Air flows into the hollow head 8 from the external with the recovery of the hollow head 8, while the check valve 10 closes not to flow away the air from the first chamber A to the second chamber B.

Again, the finger 20 is applied to the small opening 14 of the hollow head 8, and the hollow head 8 is pushed in the direction shown by the arrow 21, by the finger 20. The above operation is repeated. The volume of the first chamber A increases with the repetition of the volume-reduction and recovery of the hollow head 8. As the result, the envelope 6 is expanded as shown by the dot-dash line on FIG. 2. Since the envelope 6 is made of soft and thin material, it can contact closely with the inner surface of the external auditory miatus 3.

Since the expanded envelope 6 contacts closely with the inner surface of the external auditory miatus 3, it is held in the external auditory miatus 3. The earphone part 1 is prevented from falling off from the external auditory miatus 3 and from being dislocated from the position shown of FIG. 2. The envelope 6 can be expanded so as to conform with the external auditory miatus 3 of any shape and size. The earphone part 1 is always surely and easily held in the external auditory miatus 3, and it gives no pain in the external auditory miatus 3. As the result, the hearing aid is used under the stable condition.

When the earphone part 1 will be taken out from the external auditory miatus 3, the knob 11 of the pipe 12 is pushed in the direction shown by the arrow 13 on FIG. 3, to put the top end of the pipe 12 into the check valve 10. The check valve 10 is opened as shown by the solid line on FIG. 3. The air 23 in the first chamber A is forced to flow into the pipe 12 with the risilient force of the envelope 6, and flows through the opening 14 into the second chamber B. As soon as the check valve 10 is opened, the air 23 from the first chamber A flows through the pipe 9, the check valve 10, the pipe 12 and the opening 14 of the pipe 12 into the second chamber B. The envelope 6 is almost instantaneously withered as shown by the dot-dash line on FIG. 3. The finger is then separated from the knob 11. the pipe 12 is moved back to its original position from the check valve 10, with the resilient force of the hollow head 8. Since there is a considerable clearance between the withered enlevelope 6 and the inner surface of the external auditory miatus 3, the earphone part 1 is easily taken out therefrom in the manner that the housing 2 is pinched with fingers.

According to this embodiment, the envelope 6 can be expanded so as to contact closely with the inner surface of the auditory miatus 3, merely with the repetition of the volume-reduction and recovery of the hollow head 8. The setting operation to the external auditory miatus 3 is very easy and can be exactly effected. The expanded envelope 6 can be easily diminished, merely with the pushing of the knob 11. The setting-demounting operation of the earphone part 1 can be effected with one hand.

Next, a second embodiment of this invention will be described with reference to FIG. 4 to FIG. 7.

This embodiment is different from the first embodiment in construction of the hollow head constituting the second chamber. Parts in this embodiment which correspond to the parts in the first embodiment, will be denoted by the same reference numerals, which will not be explained again.

The pipe 9 is introduced along the external wall surface of the earphone part 1 and is connected with a relatively hard pipe 30. The pipe 30 is inserted into the inside of a pipe-shaped fixing portion 31 which is integrally formed in the housing 2, so that it is fixed on the external wall surface of the housing 2. A pinch pump 33 having a roller valve 32 is connected with the pipe 30.

Figure 5:
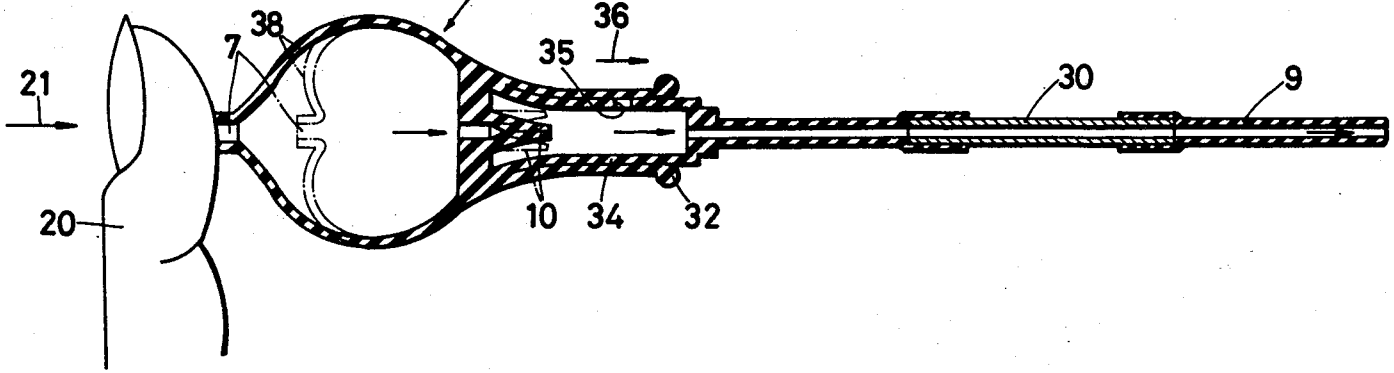
FIG. 5 is an enlarged cross-sectional view of a pinch pump portion in FIG. 4.
Figure 7:
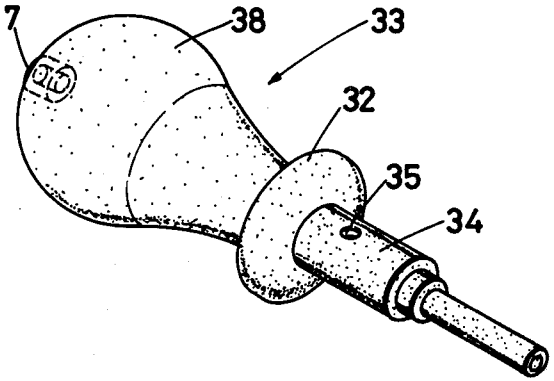
FIG. 7 is a perspective view of the pinch pump in FIG. 6.

In the pinch pump 33, as shown in FIG. 5, a hollow head 38 is fixed to one end of a pipe 34. The hollow head 38 has a small opening 7 in the central part which functions like the above-mentioned one. The above-mentioned check valve 10 is formed at the connecting portion of the hollow head 38 and the pipe 34. The pipe 34 has a small opening 35 for passing air which is normally closed by the roller valve 32 having an elasticity. The roller valve 32 is cylindrically attached to the external surface of the pipe 34. The roller valve 32 is tend to stretch normally in the direction shown by an arrow 36 with its elasticity, and to roll up forming a spiral cross-section along the pipe 34 as shown in FIG. 6 when a force by the finger is applied in the direction shown by an arrow 37.

Next, operation for the above pinch pump 33 will be described. As shown in FIG. 5, when the small opening 7 of the hollow head 38 is pushed by the finger 20 in the direction shown by the arrow 21, the hollow head 38 is elastically deformed and diminished as shown by a dot-dash line. Air having a corresponding amount to the diminishing of the hollow head 38 flows into the pipe 34 through the check valve 10 which is forced to be opened, and further flows into the first chamber A of the earphone part through the pipes 30 and 9. The pressure of the air serves to expand the envelope 6 or the first chamber A until it contacts closely with the internal wall surface of the external auditory miatus. At this time, because the check valve 10 is closed, the expanded state of the first chamber is held.

Figure 6:
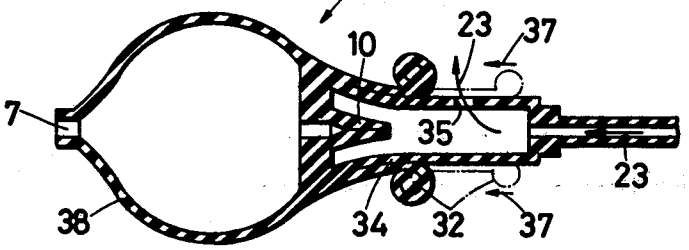
FIG. 6 is an enlarged cross-sectional view of the pinch pump portion in FIG. 4 when the first envelope is diminished.

According to this embodiment, the first envelope 6 is diminished as shown in FIGS. 5 and 6 so that the roller valve 32 is elastically rolled up by being pushed along the pipe 34 and the air 23 in the first chamber is flowed outward through the exposed small opening 35. The first envelope 6 can be diminished at one stroke and can be returned to the original state. The operation for the roller valve 32 can be very easily effected, as it were, by one-touch. The roller valve 32 can stretch to the original state from the above roll-up state with its elasticity and can close the small opening 35 again.

Figure 4:
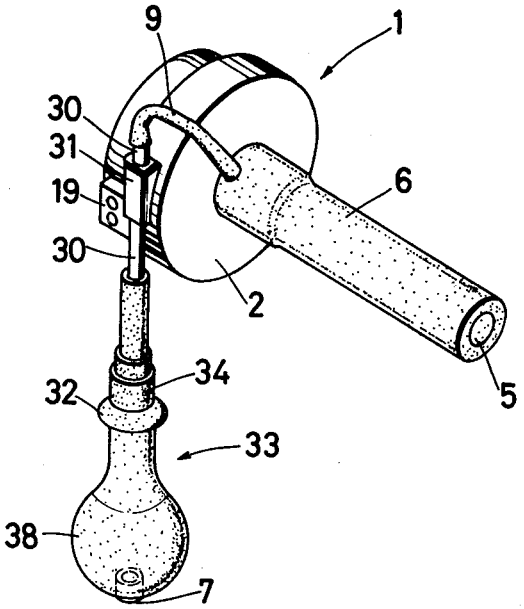
FIG. 4 is a perspective view of an earphone according to a second embodiment of this invention.

The pinch pump 33 attached to the ear-phone part 1 is being hung therefrom as shown in FIG. 4. Accordingly, the pinch pump 33 exhibits somewhat ornamental effect like a earring when the earphone part 1 is inserted into the external auditory miatus 3.

Figure 8:
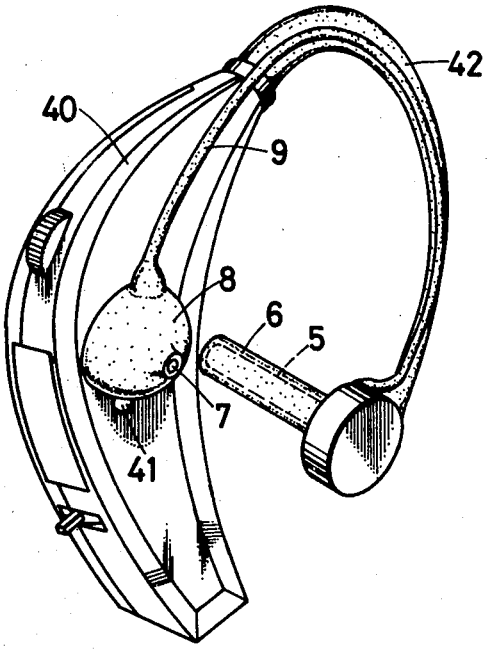
FIG. 8 is a perspective view of a hang-on type hearing aid according to a third embodiment of this invention.
Figure 9:
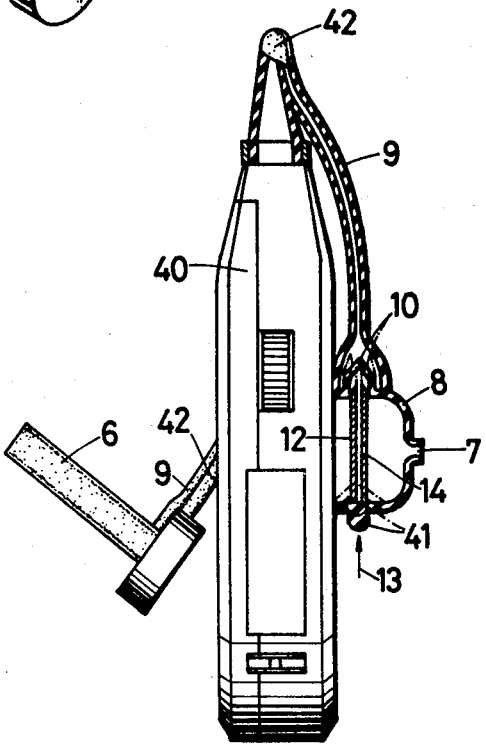
FIG. 9 is a partial cross-sectional view of the hang-on type hearing aid in FIG. 8 a part of which is modified.

Next, a third embodiment of this invention will be described with reference to FIG. 8 to FIG. 10.

A hearing aid of this embodiment is a so-called hang-on type for the ear. The hearing aid comprises a main body 40 containing a transducer for transducing sound signals to electric signals, an amplifier, an earphone and the like. The sound-leading portion 5 having the same construction as in the preceding embodiments is connected to the main body 40 through a resilient connecting pipe 42. Concretely speaking, the sound-leading portion 5 is inserted into the connecting pipe 42 and the envelope 6 is attached around the portion 5.

A resilient envelope 8 having a substantially semi-circular cross-section is fixed to the surface of the main body 40. The envelope 8 has a check valve 10 and a pipe 12 to be used for forcibly opening the check valve 10 as shown in FIG. 9. The pipe 12 has a small opening 14 for passing air. The pipe 12 is integrally united with the envelope 8, and is moved to the check valve 10 as the envelope 8 is elastically deformed as shown in a dot-dash line when a knob 41 is pushed in the direction shown by an arrow 13. The construction of the envelope 6, and the connecting mechanism of the envelope 8 and the envelope 6 through the pipe 9 are the same as in the first embodiment. The pipe 9 may be attached to the side surface of the connecting pipe 42 as shown in FIG. 8, or may be buried into the wall portion of the connecting pipe 42 as shown in FIG. 9.

Figure 10:
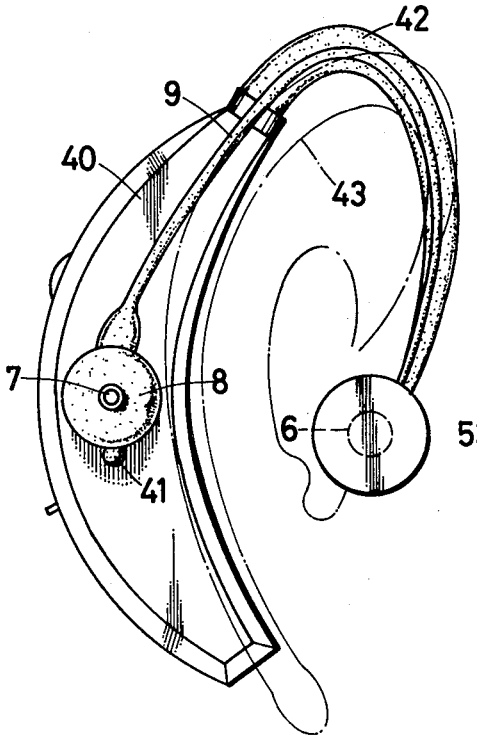
FIG. 10 is a front view of the hang-on type hearing aid in FIG. 8.

The hearing aid having the above-mentioned construction is attached to the ear 43 as shown in FIG. 10. The main body 40 is contacted with a head portion as the back side of the ear 43 and the connecting pipe 42 is introduced along the upper portion of the ear 43, and further the sound-leading portion 5 is inserted in the external auditory miatus (not shown). After the insertion of the sound-leading portion 5, the volume-reduction and the recovery of the envelope 8 are repeated so that the envelope 6 expands until contacting closely with the internal wall surface of the external auditory miatus, as described in the first embodiment. As a result, the sound-leading portion 5 can be held in the external auditory miatus.

In this embodiment, it is effected like the first embodiment that the envelope 8 is elastically deformed as shown in the dot-dash line by pushing the knob 41 to forcibly open the check valve 10. Since the hearing aid of this embodiment is the hang-on type for the ear and has the main body 40 containing inside the transducer, the amplifier, the earphone part and the like, the construction and the handling can become simplified and a howling can be prevented in comparison with the first embodiment.

Variously modified examples for the second envelope in the preceding embodiments will be now described with reference to FIG. 11 to FIG. 17.

Figure 11:
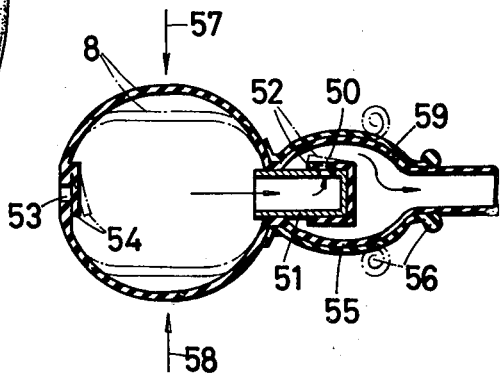
FIG. 11 to FIG. 17 are cross-sectional views of a second envelope portion according to modified examples of the preceding embodiments.

According to an example shown in FIG. 11, a pipe 51 having a small opening 50 is fixed to one end of the hollow head 8 and an elastically deformable switching valve 52 is chosely attached to close the opening 50. A small opening 53 is formed in the wall portion of the hollow head 8. A resilient switching valve 54 is formed in the wall portion to close the opening 53. An enlarged cross-sectional portion 55 is formed in series with the hollow head 8 and a roller valve 56 as in the second embodiment is attached to the inclined surface of the portion 55. The operation will be next described. When the hollow head 8 is elastically diminished by pinching from both sides, i.e. in the direction shown by arrows 57 and 58, the valve 50 is opened as shown by a dot-dash line by the action of the air pressure. At the moment, air having a corresponding amount to the diminishing of the hollow head 8 flows into the portion 55 through the exposed opening 50 and further flows into the first envelope to expand the latter. After the diminishing of the hollow head 8, this can return to the original state with its elasticity so that the valve 54 is opened as shown by a dot-dash line to let the external air flow into the hollow head 8 through the opening 53. At that time, a force is exerted on the valve 52 in such a direction that the latter is tightly contacted with the pipe 51, so that the opening 50 is completely closed by the valve 52. To diminish the first envelope, the roller valve 56 is rolled up to form a spiral cross-section along the portion 55 as mentioned above and air is discharged through the exposed opening 59.

Figure 12:
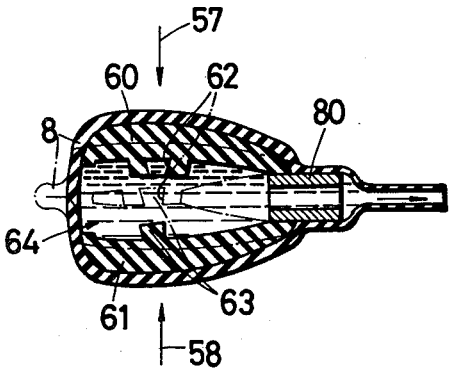

In an example shown in FIG. 12, arms 60 and 61 fittable and opposed to each other are disposed at the internal wall surface of the second envelope 8. The arms 60 and 61 are fixed to a pipe 80 and can be elastically deformed at the fixed portion. A concave 62 and a convex 63 having trapezoidal cross-section are formed in the internal surface of the arms 60 and 61 respectively. Liquid 64 such as water or ethyleneglycol is enclosed in the envelope 8. When the arms 60 and 61 are pinched in the directions shown by arrows 57 and 58 to be approached to each other, they are closely fitted as shown by a dot-dash line. As a result, the liquid 64 is introduced into the first envelope with the deformation of the envelope 8. According to this example, the operation is easily effected because the first envelope can be expanded merely by pinching the arms 60 and 61. When the first envelope is diminished, the fitted arms 60 and 61 can be easily separated to forcibly return the liquid in the first envelope to the envelope 8 by pinching the arms 60 and 61 from both sides in the perpendicular direction to the sheet surface of the drawing.

Figure 13:
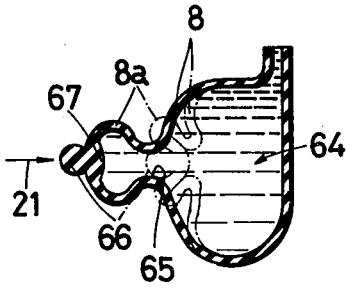

The first envelope 8 according to an example shown in FIG. 13 has further a small chamber **8*a* which is communicated with the main envelope 8 through an opening 65. A knob 66 is integrally formed on the external surface of the chamber 8*a*. When the knob 66 is pushed into the chamber 8*a* in the direction shown by an arrow 21, a thick portion 67 formed at the knob 66 is held in the opening 65 as shown by a dot-dash line and a part of the chambers 8*a* and the envelope 8 is elastically deformed. As a result, a liquid 64 is forcibly flowed into the first envelope with the deformation or diminishing of the envelope 8. In order to diminish the first envelope, the knob 67 is pulled by finger in the deformation state of the chamber 8*a* so that the chamber 8*a* and the envelope 8 return to the original shape and the liquid 64 flows into the envelope 8. According to this example, the handling and the construction can become simplified because the expansion and diminution of the first envelope can be effected merely by pushing and pulling the knob 66**.

Figure 14:
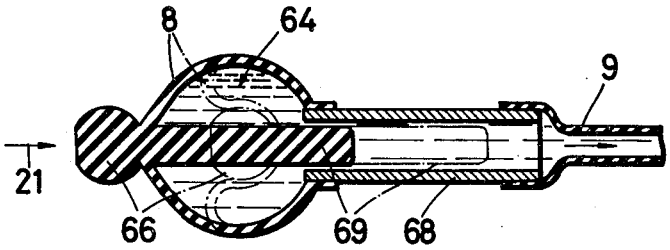

In an example shown in FIG. 14, the second envelope 8 or the hollow head is fixed to a pipe 68. A guide rod 69 is formed in the internal wall surface of the envelope 8. The guide rod 69 is partially inserted into the pipe 68. When a knob 66 formed on the external surface of the envelope 8 is pushed thereinto, the envelope 8 is elastically deformed as shown by a dot-dash line to stick the knob 66 into the deformed portion of the envelope 8. As a result, the knob 66 is elastically held in the deformed portion. During this operation the liquid 64 flows into the first envelope. The operation can be reliably performed because of the presence of the guide rod 69.

Figure 15:
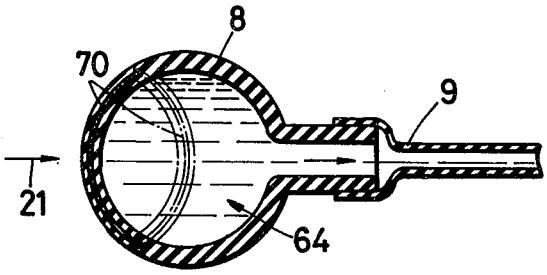

The second envelope 8 according to an example shown in FIG. 15 has a plate spring 70 which is buried in the wall portion thereof. When the plate spring 70 is pushed in the direction shown by an arrow 21, it is elastically deformed as shown by a dot-dash line with a click action to supply the liquid 64 into the first envelope. This operation can be effected only by pushing or deforming the plate spring 70. To diminish the first envelope, the deformed plate spring 70 is pushed in the reverse direction of the arrow 21 so as to return to the original shape at one stroke.

Figure 16:
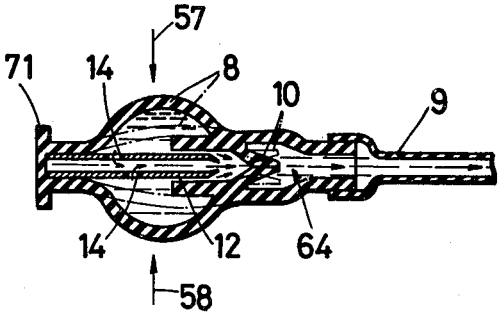
Figure 17:
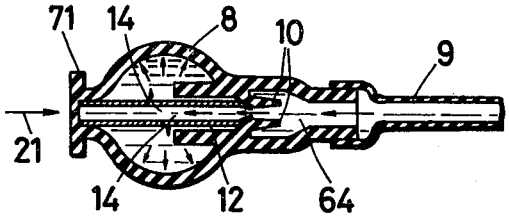

In an example shown in FIG. 16 and 17, a pipe 12 having a small opening 14 is attached to the first envelope 8. When the envelope 8 is pinched and diminished in the directions shown by arrows 57 and 58, a liquid 64 flowing through the pipe 12 from the opening 14 and flowing around the pipe 12 acts on a check valve 10 to open the latter. The liquid 64 is introduced into the first envelope through the clearance of the valve 10. When the first envelope is diminished, a knob 71 formed integrally on the envelope 8 is pushed in the direction shown by an arrow 21 to forcibly open the check valve 10 by the end of the pipe 12, as shown in FIG. 17. As a result, the liquid 64 in the first envelope can return to the envelope 8 through the pipe 12 and the opening 14 and the envelope 8 can elastically expand to the original state.

Moreover, the examples shown in FIG. 11 to FIG. 17 can be further modified. For example, the envelope 8 can be hung down from the earphone part like the pinch pump 33 described in the second embodiment. The envelope 8 and the related portions can be changed in shape and can directly attached to the earphone part or the main body of the hearing aid as in the first or third embodiment. As to the changing of the shape or position of each portion, for example, the guide rod 69 shown in FIG. 14 can be constructed so that it is closely held in the pipe 68 when inserted thereinto. The sound-leading portions 4 and 5 shown in FIG. 2 may be formed by a single pipe, and the envelopes 6 and 8 may be connected in another way. The roller valve 32 shown in FIG. 5 may not be closely contacted with the whole surface of the pipe 34, but may be closely contacted only with the opening 35. This invention can be applied also to an earphone used in a television set or radio set as well as a stethoscope.

It will be evident that further varions modifications can be made to the described embodiments without departing from the scope of this invenion.

What is claimed is:

1. In a plug-type hearing device including a sound-conducting portion for insertion into the auditory miatus and for introducing a sound thereinto, a first envelope of elastic material formed around said sound-conducting portion, a fluid, and a passage for said fluid connected at one end to said first envelope for supplying said fluid to the first envelope from a source connected to the other end of the passage, expanding means for expanding said first envelope within the miatus by supplying said fluid thereinto, and holding means for maintaining the expanded state of said first envelope, said expanded first envelope being closely contacted with a wall surface forming said auditory miatus, the improvement in said expanding and holding means comprising a resiliently deformable valve disposed in said passage for said fluid, and means for applying pressure to said fluid comprising a second envelope communicating with said first envelope through said passage and disposed outside of said auditory miatus, the volume of said second envelope being decreased to increase the volume of said first envelope through the pressure of said fluid, said second envelope being made of an elastic material and being attached to a main body of an earphone having said sound-conducting portion, said valve being resiliently deformable by the pressure of said fluid whereby the fluid can pass through said valve into said first envelope, and said valve being resiliently returned to a state closing said passage when said pressure is relieved whereby said first envelope is held in the expanded state, said valve comprising a check valve, and including means for opening said valve to return said fluid into said second envelope, said opening means comprising a pipe attached to the inner wall of said second envelope, said pipe being adapted to be forced into engagement with said check valve to open the check valve.

2. A plug-type hearing device according to claim 1 including at least one aperture in said pipe through which said fluid passes when returning to said second envelope.

3. A plug-type hearing device according to claim 1 wherein said sound-conducting portion comprises a hard pipe functioning as a core when inserted into said auditory miatus.

4. A plug-type hearing device according to claim 1 wherein said fluid comprises a material selected from the group consisting of air and ethylene glycol.

5. A plug-type hearing device according to claim 1 wherein the device is adapted to be hung on the ear and comprises a transducer, an amplifier, and an earphone, and wherein said sound-leading portion is connected to said earphone which is contained in the main body portion of the device.

6. In a plug-type hearing device including a sound-conducting portion for insertion into the auditory miatus and for introducing a sound thereinto, a first envelope of elastic material formed around said sound-conducting portion, a fluid, and a passage for said fluid connected at one end to said first envelope for supplying said fluid to the first envelope from a source connected to the other end of the passage, expanding means for expanding said first envelope within the miatus by supplying said fluid thereinto, and holding means for maintaining the expanded state of said first envelope, said expanded first envelope being closely contacted with a wall surface forming said auditory miatus, the improvement in said expanding and holding means comprising a resiliently deformable valve disposed in said passage for said fluid, and means for applying pressure to said fluid said valve being resiliently deformable by the pressure of said fluid whereby the fluid can pass through said valve into said first envelope, and said valve being resiliently returned to a state closing said passage when said pressure is relieved whereby said first envelope is held in the expanded state, comprising a second envelope communicating with said first envelope through said passage and disposed outside of said auditory miatus, the volume of said second envelope being decreased to increase the volume of said first envelope through the pressure of said fluid, said second envelope being made of an elastic material and being attached to a main body of an earphone having said sound-conducting portion, and wherein said passage includes a pipe section, and including a second valve comprising a roller valve attached to the outer surface of said pipe section, and an opening defined by said pipe section adapted to be exposed by said roller valve whereby said fluid is adapted to be discharged from said first envelope.

7. A plug-type hearing device according to claim 6 wherein said sound-conducting portion comprises a hard pipe functioning as a core when inserted into said auditory miatus.

8. A plug-type hearing device according to claim 6 wherein said fluid comprises a material selected from the group consisting of air and ethylene glycol.

9. A plug-type hearing device according to claim 6 wherein the device is adapted to be hung on the ear and comprises a transducer, an amplifier, and an earphone, and wherein said sound-leading portion is connected to said earphone which is contained in the main body portion of the device.

10. A plug-type hearing device according to claim 6 wherein said roller valve is attached in surrounding relationship to said pipe section in such a manner that said opening is normally closed by said roller valve, said roller valve being adapted to be rolled up on itself along said outer surface into a ring-shaped configuration whereby said opening is exposed to permit discharge of said fluid, said roller valve being formed of an elastic material whereby said roller valve normally resists being rolled up on itself and is elastically restored by its elastic force to its original state to close said opening when rolling force is removed.

11. A plug-type hearing device according to claim 10 wherein said check valve comprises a cylindrical member positioned within said pipe section, said cylindrical member being forcibly opened by fluid pressure resulting from said second envelope being contracted, and said cylindrical member being closed by its own elastic force.

12. In a plug-type hearing device including a sound-conducting portion for insertion into the auditory miatus and for introducing a sound thereinto, a first envelope formed around said sound-conducting portion, a fluid, and a passage for said fluid connected at one end to said first envelope for supplying said fluid to the first envelope from a source comprising a second envelope which is connected to the other end of the passage, said second envelope being deformable whereby said fluid is forced through said passage and into said first envelope for expanding said first envelope within the miatus, and holding means for maintaining the expanded state of said first envelope, said expanded first envelope being closely contacted with a wall surface forming said auditory miatus, the improvement in said expanding and holding means wherein said second envelope includes actuating members formed of elastic material whereby facing wall surfaces thereof are normally held in spaced-apart relationship, locking means for placing said second envelope in a deformed state, said locking means comprising cooperating locking devices disposed on the respective facing wall surfaces of said actuating members whereby forcing of said actuating members together operates to unite the locking devices and to thereby lock the actuating members together, said locking means being automatically operable upon application of deforming pressure to said second envelope whereby the first envelope is held in the expanded state and means for releasing said locking means by subsequent application of deforming pressure to the second envelope whereby said fluid returns through said passage to the second envelope and the first envelope is restored to an unexpanded state.

13. A plug-type hearing device according to claim 12 wherein said locking devices comprise a truncated-cone shaped recess positioned on one wall surface and a truncated-cone projection positioned on the opposite wall surface, said projection being receivable within said recess to achieve the locking function.

14. A plug-type hearing device according to claim 12 wherein said actuating members include means for attachment of the actuating members to said other end of said passage, the actuating members being pivotable about said connection with said passage.

15. A plug-type hearing device according to claim 12 wherein said sound-conducting portion comprises a hard pipe functioning as a core when inserted into said auditory miatus.

16. A plug-type hearing device according to claim 12 wherein said first and second envelopes are formed of elastic material, and wherein said second envelope is attached to the main body of an earphone.

17. A plug-type hearing device according to claim 12 wherein the device is adapted to be hung on the ear and comprises a transducer, an amplifier, and an earphone, and wherein said sound-leading portion is connected to said earphone which is contained in the main body portion of the device.

18. A plug-type hearing device according to claim 12 wherein said fluid comprises a material selected from the group consisting of air and ethylene glycol.

19. In a plug-type hearing device including a sound-conducting portion for insertion into the auditory miatus and for introducing a sound thereinto, a first envelope formed around said sound-conducting portion, a fluid, and a passage for said fluid connected at one end to said first envelope for supplying said fluid to the first envelope from a source comprising a second envelope which is connected to the other end of the passage, said second envelope being deformable whereby said fluid is forced through said passage and into said first envelope for expanding said first envelope within the miatus, and holding means for maintaining the expanded state of said first envelope, said expanded first envelope being closely contacted with a wall surface forming said auditory miatus, the improvement in said expanding and holding means comprising locking means for placing said second envelope in a deformed state, said locking means being automatically operable upon application of deforming pressure to said second envelope whereby the first envelope is held in the expanded state and means for releasing said locking means by subsequent application of deforming pressure to the second envelope whereby said fluid returns through said passage to the second envelope and the first envelope is restored to an unexpanded state, and wherein said locking means comprise a knob formed on the exterior of said second envelope, the application of pressure to said knob driving the knob inwardly whereby folds formed by the walls of the second envelope are positioned around the knob to hold the knob in the inward position, and wherein the knob is adapted to be released from the inward position by moving the knob outwardly, and including a guide rod extending inwardly from said knob within said second envelope, said passage including a tubular member receiving said guide rod whereby the inward and outward movements of said knob are controlled by said guide rod.

20. A plug-type hearing device according to claim 19 wherein the device is adapted to be hung on the ear and comprises a transducer, an amplifier, and an earphone, and wherein said sound-leading portion is connected to said earphone which is contained in the main body portion of the device.

21. A plug-type hearing device according to claim 19 wherein said first and second envelopes are formed of elastic material, and wherein said second envelope is attached to the main body of an earphone.

22. A plug-type hearing device according to claim 19 wherein said fluid comprises a material selected from the group consisting of air and ethylene glycol.

23. A plug-type hearing device according to claim 19 wherein said sound-conducting portion comprises a hard pipe functioning as a core when inserted into said auditory miatus.

24. In a plug-type hearing device including a sound-conducting portion for insertion into the auditory miatus and for introducing a sound thereinto, a first envelope formed around said sound-conducting portion, a fluid, and a passage for said fluid connected at one end to said first envelope for supplying said fluid to the first envelope from a source comprising a second envelope which is connected to the other end of the passage, said second envelope being deformable whereby said fluid is forced through said passage and into said first envelope for expanding said first envelope within the miatus, and holding means for maintaining the expanded state of said first envelope, said expanded first envelope being closely contacted with a wall surface forming said auditory miatus, the improvement in said expanding and holding means comprising locking means for placing said second envelope in a deformed state, said locking means being automatically operable upon application of deforming pressure to said second envelope whereby the first envelope is held in the expanded state and means for releasing said locking means by subsequent application of deforming pressure to the second envelope whereby said fluid returns through said passage to the second envelope and the first envelope is restored to an unexpanded state, said locking means comprising a spring plate located in the wall of said second envelope, said spring plate defining a first position prior to deformation of said second envelope whereby said fluid is substantially maintained in said second envelope, said spring plate being deformable upon application of pressure to said second envelope to a second position whereby the fluid is forced into said first envelope, said spring plate being adapted to maintain said second position until said subsequent application of deforming pressure.

25. A plug-type hearing device according to claim 24 wherein said sound-conducting portion comprises a hard pipe functioning as a core when inserted into said auditory miatus.

26. A plug-type hearing device according to claim 24 wherein said first and second envelopes are formed of elastic material, and wherein said second envelope is attached to the main body of an earphone.

27. A plug-type hearing device according to claim 24 wherein said fluid comprises a meterial selected from the group consisting of air and ethylene glycol.

28. A plug-type hearing device according to claim 24 wherein the device is adapted to be hung on the ear and comprises a transducer, an amplifier, and an earphone, and wherein said sound-leading portion is connected to said earphone which is contained in the main body portion of the device.

* * * * *